US010344695B1

(12) United States Patent
Bergstedt et al.

(10) Patent No.: US 10,344,695 B1
(45) Date of Patent: Jul. 9, 2019

(54) ENGINE CONTROLS INCLUDING DYNAMIC LOAD CORRECTION

(71) Applicant: Cummins Inc., Columbus, IN (US)

(72) Inventors: Randal L. Bergstedt, Colubus, IN (US); Rohit Saha, Columbus, IN (US); Martin T. Books, Columbus, IN (US); Richard G. Varo, Columbus, IN (US); Jagdeep I. Singh, Columbus, IN (US); Bibhu Batchal Mahanta, Pune (IN)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 15/918,145

(22) Filed: Mar. 12, 2018

(51) Int. Cl.
*F02D 41/14* (2006.01)
*F02D 41/30* (2006.01)

(52) U.S. Cl.
CPC ..... *F02D 41/1402* (2013.01); *F02D 41/30* (2013.01); *F02D 2041/141* (2013.01); *F02D 2041/1432* (2013.01); *F02D 2200/101* (2013.01); *F02D 2200/1002* (2013.01)

(58) Field of Classification Search
CPC ..... F02D 41/14; F02D 41/1402; F02D 41/30; F02D 2041/141; F02D 2041/1432; F02D 2200/1002; F02D 2200/101
See application file for complete search history.

(56) References Cited

U.S. PATENT DOCUMENTS 5,781,875 A * 7/1998 Maki ..... F02D 41/008 123/480
5,988,140 A 11/1999 Gartner et al.
6,165,102 A 12/2000 Bellinger
6,564,774 B2 * 5/2003 Ellims ..... F02D 31/001 123/352
6,876,097 B2 4/2005 Thomas et al.
7,235,892 B2 6/2007 Zook
8,676,457 B2 3/2014 Peterson et al.

* cited by examiner

*Primary Examiner* — Hieu T Vo
(74) *Attorney, Agent, or Firm* — Taft Stettinius & Hollister LLP

(57) ABSTRACT

An internal combustion engine operatively coupled with a variable load and an electronic control system operatively coupled with the internal combustion engine. The electronic control system is structured to receive an engine speed target value, a first engine speed feedback value, and a second engine speed feedback value. The electronic control system processes the first engine speed feedback value and the second engine speed feedback value to determine a feedforward correction value. The feedforward correction value is determined to correct for first variation between the second engine speed feedback value and the first engine speed feedback value due to variation in the variable load and to distinguish between the first variation and a second variation due to operation of the internal combustion engine. The control system processes the first engine speed feedback value target, the second engine speed feedback value and the feedforward correction value to determine an engine fueling command, and controls fueling of the internal combustion engine using the fueling command.

21 Claims, 7 Drawing Sheets

ENGINE CONTROLS INCLUDING DYNAMIC LOAD CORRECTION

BACKGROUND

The present application relates generally to engine controls including dynamic correction for variation in the magnitude of a load driven internal combustion engine. Internal combustion engines may be utilized to drive variable loads in a number of industrial applications including mechanical load systems, hydraulic load systems, pneumatic load systems and combinations thereof, which may be employed in vehicles, work machines, construction equipment, mining equipment, pumping systems or generation systems, to name several examples. Under some operating conditions the magnitude of a load driven by an engine may vary sufficiently rapidly that existing engine controls overshoot or undershoot a targeted or commanded engine speed. Under such circumstances undesirable engine operating conditions may occur including undesirable engine noise, acceleration or deceleration and variation in torque or power. Furthermore, some industrial engine systems may be configured to operate at fixed engine speed and may exhibit significant, sensitivity to engine speed variation during load transients. In some example applications engine speed overshoot greater than less than 150 rpm and engine speed undershoot greater than 250 rpm may pose a significant concern to operators. Therefore, there remains a significant need for the systems and methods to improve engine response by correcting dynamically as a function of engine loading and torsional vibration disclosed herein.

DISCLOSURE OF ILLUSTRATIVE EMBODIMENTS

For the purposes of clearly, concisely and exactly describing illustrative embodiments of the present disclosure, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art.

SUMMARY OF THE DISCLOSURE

Apparatuses, systems and methods providing dynamic correction for variation in a load driven by an internal combustion engine are disclosed. Certain exemplary embodiments include unique engine control systems structured to determine and correct for dynamic variation in the magnitude of a load driven by an internal combustion engine. Certain exemplary embodiments include unique engine control methods for determining and correcting for dynamic variation in the magnitude of a load driven by an internal combustion engine. Certain exemplary embodiments include unique engine control apparatuses including one or more electronic control system components structured to determine and correct for dynamic variation in the magnitude of a load driven by an internal combustion engine. Further embodiments, forms, objects, features, advantages, aspects, and benefits shall become apparent from the following description and drawings.

DETAILED DESCRIPTION OF ILLUSTRATIVE EMBODIMENTS

Figure 1:
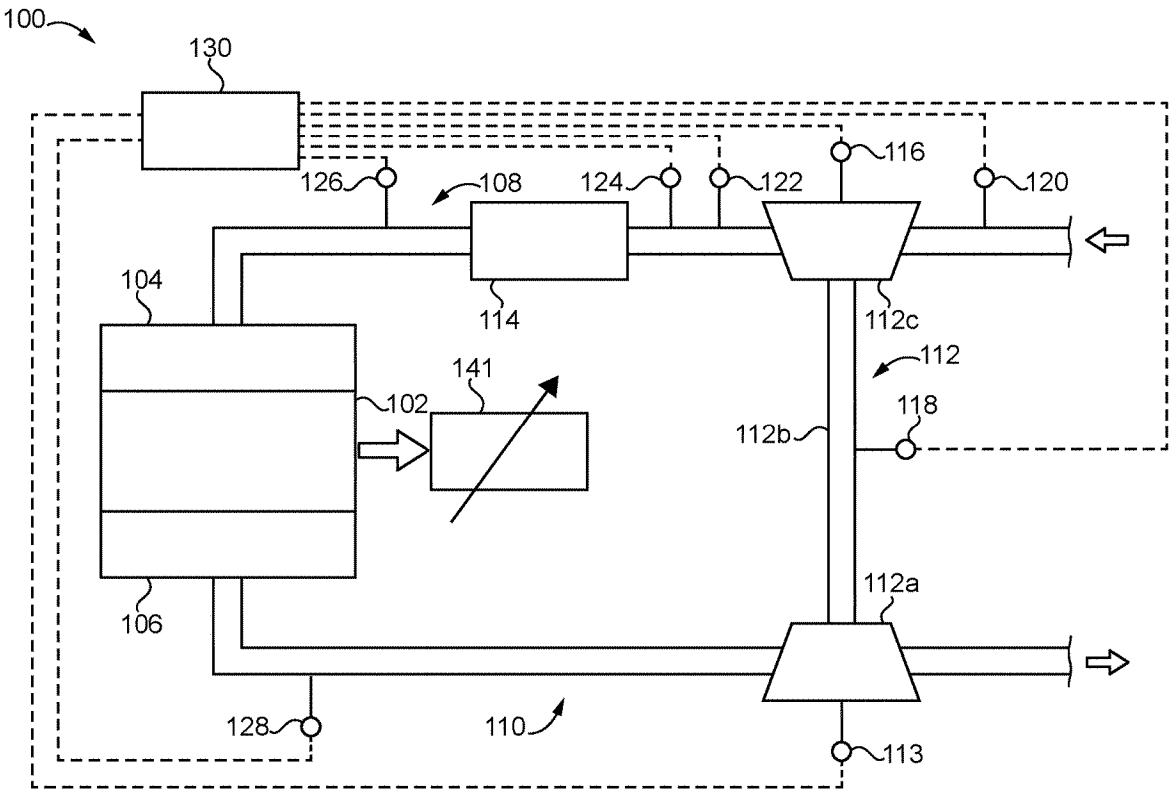
FIG. 1 is a schematic diagram illustrating certain aspects of an exemplary engine system.

With reference to FIG. 1 there is illustrated a schematic view of an example engine system 100 including an engine 102, such as an internal combustion engine or a combination of an internal combustion and other prime mover components. Engine 102 is structured to output torque to drive a variable load 141. Variable load 141 may be a high variability load such as a hydraulic load, a pneumatic or a mechanical load which can experience rapid variation in the load imposed on engine 102. Engine 102 may be provided in a variety of industrial machine systems including, for example, off highway work machines such as excavators, loaders and mining haul trucks, on-highway vehicle systems, hydraulic pumping systems, pneumatic systems and power generation systems. It shall be appreciated that the illustrated embodiment of system 100 is but one example of an engine system contemplated by the present disclosure and that a variety of other engine systems including additional or alternate components and features as well as other engine systems not including one or more of the features of the illustrated embodiment are contemplated.

In the illustrated embodiment, system 100 includes a turbocharger 112 operatively coupled with an intake system 108 and an exhaust system 110 of engine 102. The engine 102 is in fluid communication with the intake system 108 through which charge air enters an intake manifold 104 of the engine 102 and is also in fluid communication with the exhaust system 110, through which exhaust gas resulting from combustion exits by way of an exhaust manifold 106 of the engine 102, it being understood that not all details of these systems are shown. The engine 102 includes a number of cylinders forming combustion chambers into which fuel is injected by fuel injectors to combust with the charge air that has entered through intake manifold 104. The energy released by combustion, powers the engine 102 via pistons connected to a crankshaft. Intake valves control the admission of charge air into the cylinders, and exhaust valves control the outflow of exhaust gas through exhaust manifold 106 and ultimately to the atmosphere.

The turbocharger 112 is operable to compress ambient air before the ambient air enters the intake manifold 104 of the engine 102 at increased pressure. It is contemplated that in the engine system 100 including the turbocharger 112, the turbocharger 112 may include a variable geometry turbocharger (VGTs), fixed geometry turbocharger, twin-turbochargers, and/or series or parallel configurations of multiple turbochargers, as well as other turbocharger or supercharger systems, devices and configurations. The illustrated turbocharger 112 includes a bearing housing 112*b* for housing bearings and a shaft connecting a turbine 112*a* coupled to the exhaust system 110 with a compressor 112*c* coupled to the intake system 108. The air from the compressor 112*c* is pumped through the intake system 108, to the intake manifold 104, and into the cylinders of the engine 102, typically producing torque on the crankshaft.

The intake system 108 includes a charge after cooler (CAC) 114 operable to cool the charge flow provided to the intake manifold 104. It is contemplated that in certain embodiments the CAC 114 may include charge air cooler bypass values, or that the CAC 114 may not be present altogether. The intake system 108 and/or the exhaust system 110 may further include various components not shown, such as coolers, valves, bypasses, an exhaust gas recirculation (EGR) system, intake throttle valves, exhaust throttle valves, EGR valves, and/or compressor bypass valves, for example.

The engine system 100 further includes a controller 130 structured to perform certain operations and to receive and interpret signals from any component and/or sensor of the engine system 100. It shall be appreciated that the controller 130 may be provided in a variety of forms and configurations including one or more computing devices forming a whole or a part of a processing subsystem having non-transitory memory storing computer executable instructions, processing, and communication hardware. The controller 130 may be a single device or a distributed device, and the functions of the controller 130 may be performed by hardware or software. The controller 130 is in communication with any actuators, sensors, datalinks, computing devices, wireless connections, or other devices to be able to perform any described operations.

The processing logic may be implemented as modules, which may be implemented in operating logic as operations by software, hardware, artificial intelligence, fuzzy logic, or any combination thereof, or at least partially performed by a user or operator. In certain embodiments, modules represent software elements as a computer program encoded on a computer readable medium, wherein a computer performs the described operations when executing the computer program. A module may be a single device, distributed across devices, and/or a module may be grouped in whole or in part with other modules or devices. The operations of any module may be performed wholly or partially in hardware/software or by other modules.

The controller 130 includes stored data values, constants, and functions, as well as operating instructions stored on computer readable medium. Any of the operations of exemplary procedures described herein may be performed at least partially by the controller. Other groupings that execute similar overall operations are understood within the scope of the present application. More specific descriptions of certain embodiments of the controller 130 operations are discussed herein in connection with FIG. 2. Operations illustrated are understood to be exemplary only, and operations may be combined or divided, and added or removed, as well as re-ordered in whole or in part.

The engine system 100 includes a turbine housing temperature sensor 113, a compressor housing temperature sensor 116, and a bearing housing temperature sensor 118, each operable to provide a signal to the controller 130 indicating the temperature of each of the respective housings of the turbocharger 112. The engine system 100 additionally includes a mass air flow (MAF) sensor 120, an ambient air temperature sensor 122, an ambient air pressure sensor 124, and an intake pressure sensor 126, each in fluid communication with the intake system 108. The engine system 100 further includes an exhaust temperature sensor 128 in fluid communication with the exhaust system 110. The sensors described herein need not be in direct communication with the intake system 108 or the exhaust system 110 and can be located at any position within the intake system 108 or the exhaust system 110 that provides a suitable indication of applicable intake system 108 and exhaust system 110 readings.

It shall be appreciated that the foregoing sensors and sensor arrangements are but several non-limiting, illustrative embodiments of sensors and sensor systems to which the principles and techniques disclosed herein may be applied. A variety of other types of sensors and sensor configurations may be utilized including coolant temperature sensors, oil temperature sensors, EGR flow sensors, boost pressure sensors, and/or exhaust temperature sensors to name but a few examples. It shall further be appreciated that the sensors which are utilized may be physical sensors, virtual sensors, and/or combinations thereof.

The controller 130 is operatively coupled with and configured to store instructions in memory which are readable and executable by the controller 130 to control operation of engine 102 as described herein. Certain operations described herein include operations to determine one or more parameters. Determining, as utilized herein, includes calculating or computing a value, obtaining a value from a lookup table or using a lookup operation, receiving values from a datalink or network communication, receiving an electronic signal (e.g., a voltage, frequency, current, or pulse-width modulation (PWM) signal) indicative of the value, receiving a software parameter indicative of the value, reading the value from a memory location on a computer readable medium, receiving the value as a run-time parameter by any means known in the art, and/or by receiving a value by which the interpreted parameter can be calculated, and/or by referencing a default value that is interpreted to be the parameter value.

Controller 130 is one example of a component of an integrated circuit-based electronic control system (ECS) which may be configured to control various operational aspects of vehicle 100 and powertrain 102 as described in further detail herein. An ECS according to the present disclosure may be implemented in a number of forms and may include a number of different elements and configurations of elements. In certain forms an ECS may incorporate one or more microprocessor-based or microcontroller-based electronic control units sometimes referred to as electronic control modules. An ECS according to the present disclosure may be provided in forms having a single processing or computing component, or in forms comprising a plurality of operatively coupled processing or computing components; and may comprise digital circuitry, analog circuitry, or a hybrid combination of both of these types. The integrated circuitry of an EC S and/or any of its constituent processors/controllers or other components may include one or more signal conditioners, modulators, demodulators, arithmetic logic units (ALUs), central processing units (CPUs), limiters, oscillators, control clocks, amplifiers, signal conditioners, filters, format converters, communication ports, clamps, delay devices, memory devices, analog to digital (A/D) converters, digital to analog (D/A) converters, and/or different circuitry or functional components as would occur to those skilled in the art to provide and perform the communication and control aspects disclosed herein.

Figure 2A:
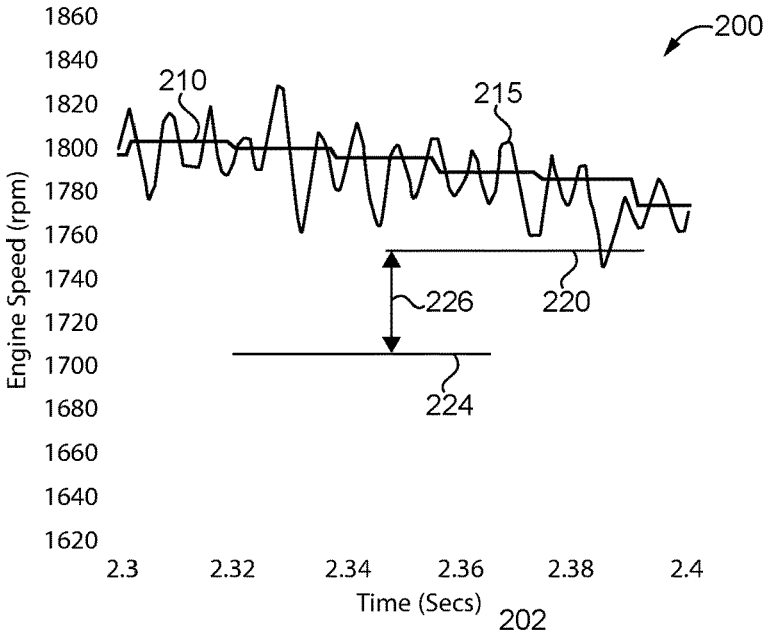
FIGS. 2A-2D are graph illustrating variation in certain engine speed parameters as a function of time under a number of operating conditions.

With reference to FIG. 2A there is illustrated a graph 200 depicting time in units of seconds on its horizontal axis and engine speed in units of rpm on its vertical axis. Graph 200 depicts filtered engine speed curve 210 and instantaneous engine speed curve 215. Instantaneous engine speed curve 215 includes variation in engine speed which occurs during engine operation due to firing of engine cylinders which is illustrated by the peaks and valleys of filtered engine speed curve 215. Such variation is present both at steady state load engine operating conditions and transient load engine operating conditions. Instantaneous engine speed curve 215 also includes variation in engine speed which occurs due to variation in the magnitude of the load being driven by the engine.

Filtered engine speed curve 210 is filtered relative to instantaneous engine speed curve 215, for example, using an averaging technique such as a moving and/or weighted average, an alpha-beta filtering technique, a state observer technique such as a Kalman filter or other techniques as would occur to one of skill in the art with the benefit of the present disclosure. As a result of filtering, filtered engine speed curve 210 does not exhibit the peaks and valleys of instantaneous engine speed curve 215 as the variation in engine speed which occurs during engine operation due to firing of engine cylinders has been reduced or eliminated by filtering.

The engine speed delta 226 ($\Delta N$) in graph 200 may be determined as the difference between the filtered engine speed 210 and the instantaneous engine speed 215. In The engine speed delta 226 ($\Delta N$) may be broken into change in speed due to torque variations which occur during cylinder firing ($\Delta N_T$) and change in speed due to variation loading imposed on the engine ($\Delta N_L$) which yields equation $\Delta N=\Delta N_T+\Delta N_L$. The change in speed due to loading ($\Delta N_L$) yields equation $\Delta N_L=\Delta N-\frac{1}{2}*\Delta N_{T,max}$, where $\Delta N_{T,max}$ is the maximum change in speed due to torsional events.

Figure 2B:
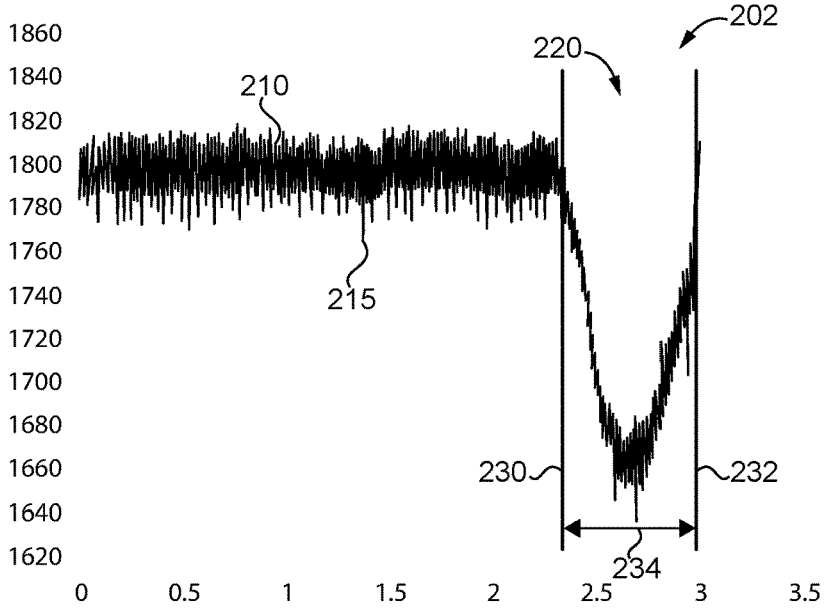

FIG. 2B shows graph 202 illustrating a system under an exemplary load transient condition depicting engine speed (rpm) on its vertical axis, time (sec.) on its horizontal axis, filtered engine speed 210, instantaneous engine speed 215, an undershoot 220, and a recovery time 234 between lines 230 and 232. The undershoot may be due to, for example, a machine moving a boom upward quickly. This may cause the instantaneous engine speed 215 to decrease as shown between offset lines 230 and 232, which results in recovery time 234. Which may be caused by the filtered engine speed 210 lagging the instantaneous engine speed 215.

Figure 2C:
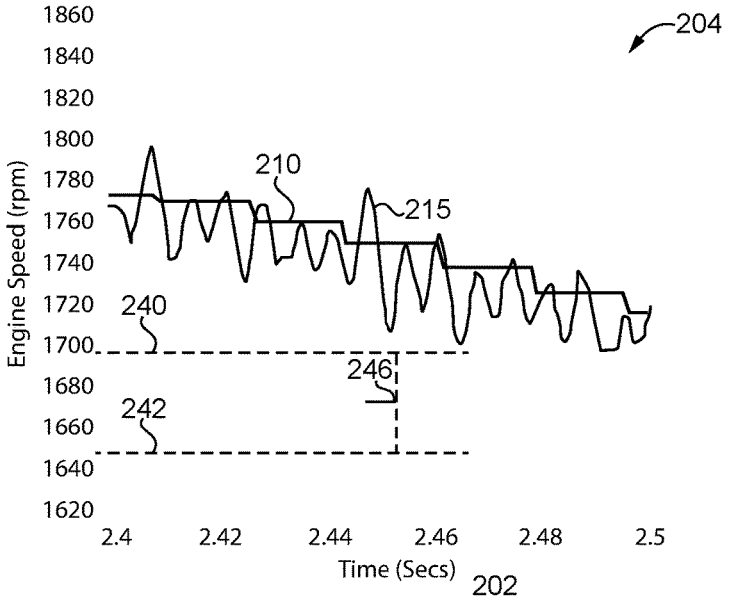

FIG. 2C shows graph 204 illustrating a system under an exemplary load transient condition depicting engine speed (rpm) on its vertical axis, time (sec.) on its horizontal axis, filtered engine speed 210, instantaneous engine speed 215, difference 246 between filtered engine speed 210 and instantaneous engine speed 215 denoted as the distance between offset lines 240 and 242. This graph shows that the difference 246 at a given time is approximately 46 rpm which may be due to the filtered engine speed 210 lagging the instantaneous engine speed 215, resulting in poor machine performance. The engine controller senses and acts on the filtered engine speed 210 which partially contributes to slow response.

Figure 2D:
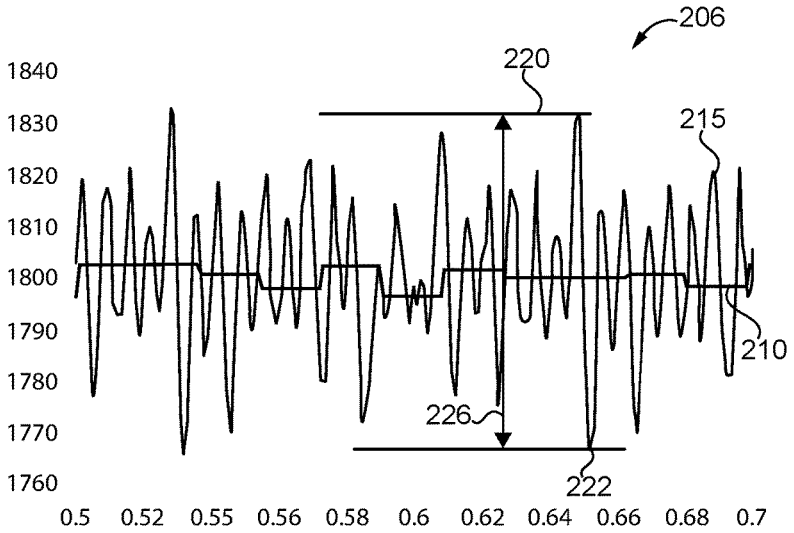

FIG. 2D shows graph 206 illustrating a system under steady state load conditions engine speed (rpm) on its vertical axis, time (sec.) on its horizontal axis, filtered engine speed 210, instantaneous engine speed 215, maximum difference 226 ($\Delta N_{T,max}$) between filtered engine speed 210 and instantaneous engine speed 215, as shown between lines 220 and 222. Line 220 is the highest peak of instantaneous speed 215, and line 222 is the lowest peak of instantaneous speed 215.

Figure 3:
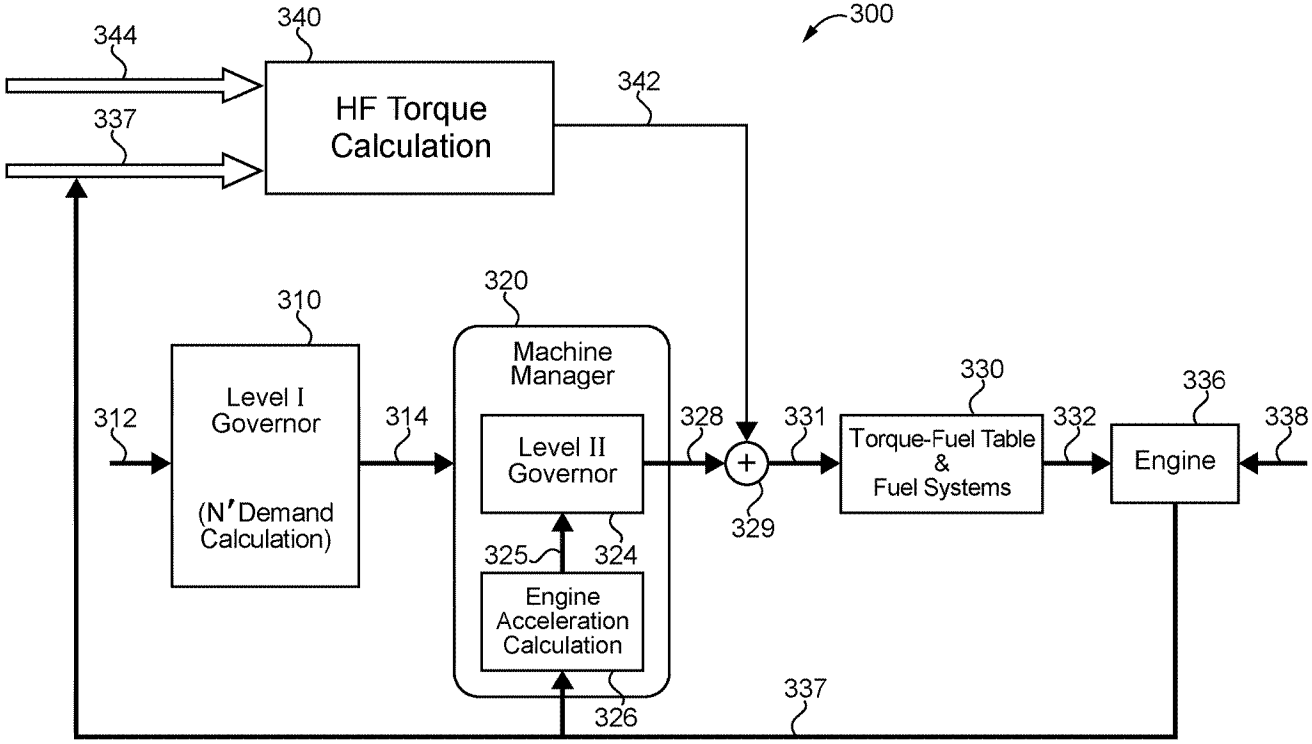
FIG. 3 is a block diagram illustrating certain aspects of exemplary engine controls.

With reference to FIG. 3 there is illustrated a block diagram depicting certain aspects of exemplary engine controls 300 which may be implemented in one or more control components of an electronic control system such as one or more electronic control system components illustrated and described in connection with FIG. 1. Controls 300 include one or more level I governors such as governor 310 which is structured to control engine speed. Governor 310 is structured as a feedback controller which receive as input an engine speed target value 312, sometimes referred to as an engine speed reference value, and a filtered engine speed feedback value 337. Governor 310 determines and outputs an engine acceleration target value 314 to reduce the difference or error between the engine speed target value 312 and the filtered engine speed feedback value 337. The engine acceleration target value 314 may be expressed as the first derivative of engine speed (N') and indicates a demanded change in engine speed to reduce the error between the inputs to governor 310. Engine acceleration target value 314 is provided to level II governor 324 of machine manager 320.

Machine manager 320 includes one or more level II governors such as governor 324 which is structured to control engine torque and an engine acceleration calculator 326 which receives and processes the filtered engine speed feedback value 337 and determines and outputs an engine acceleration feedback value 325. Governor 324 is structured as a feedback controller, which receive as input the engine acceleration target value 314 and the engine acceleration feedback value 325. Governor 324 determines and outputs an engine torque target value 328 to reduce the difference or error between the engine acceleration target value 314 and the engine acceleration feedback value 325. The engine torque target value 328 is provided to summation operator 329 which is one example of a correction control component structured to correct an engine torque target value using a feedforward correction value.

Controls 300 further include feedforward control component 340. In the embodiment of FIG. 3 feedforward control component 340 is structured to receive as input a high frequency engine speed feedback value 344 and the filtered engine speed feedback value 337 and to determine and output a feedforward torque correction value 342. One example of operations that may be performed by feedforward control component 340 is described in connection with process 400 of FIG. 4, it being appreciated that other types of correction factor determinations may be utilized in other embodiments. Feedforward correction value 342 provided to summation operator 329 which determines and outputs a corrected engine torque target value 331 as the sum of the engine torque target value 328 and feedforward correction value 342. Corrected engine torque target value 331 is provided to torque-fuel table and fuel systems operator 330 which is structured to determine and output one or more fueling commands 332. In certain embodiments torque-fuel table and fuel systems operator 330 may determine one or more fueling control parameters, such fueling quantities, timings and rail pressures using one or more multidimensional lookup tables which correlate fueling control parameters to torque requests and other operating parameters. The fuel system components of engine 336 are structured to receive the one or more fueling commands 332 and to control fueling of the engine in response thereto. The operation of the engine is of course also influenced by the magnitude of variable load 338 which is driven by the engine.

Figure 4:
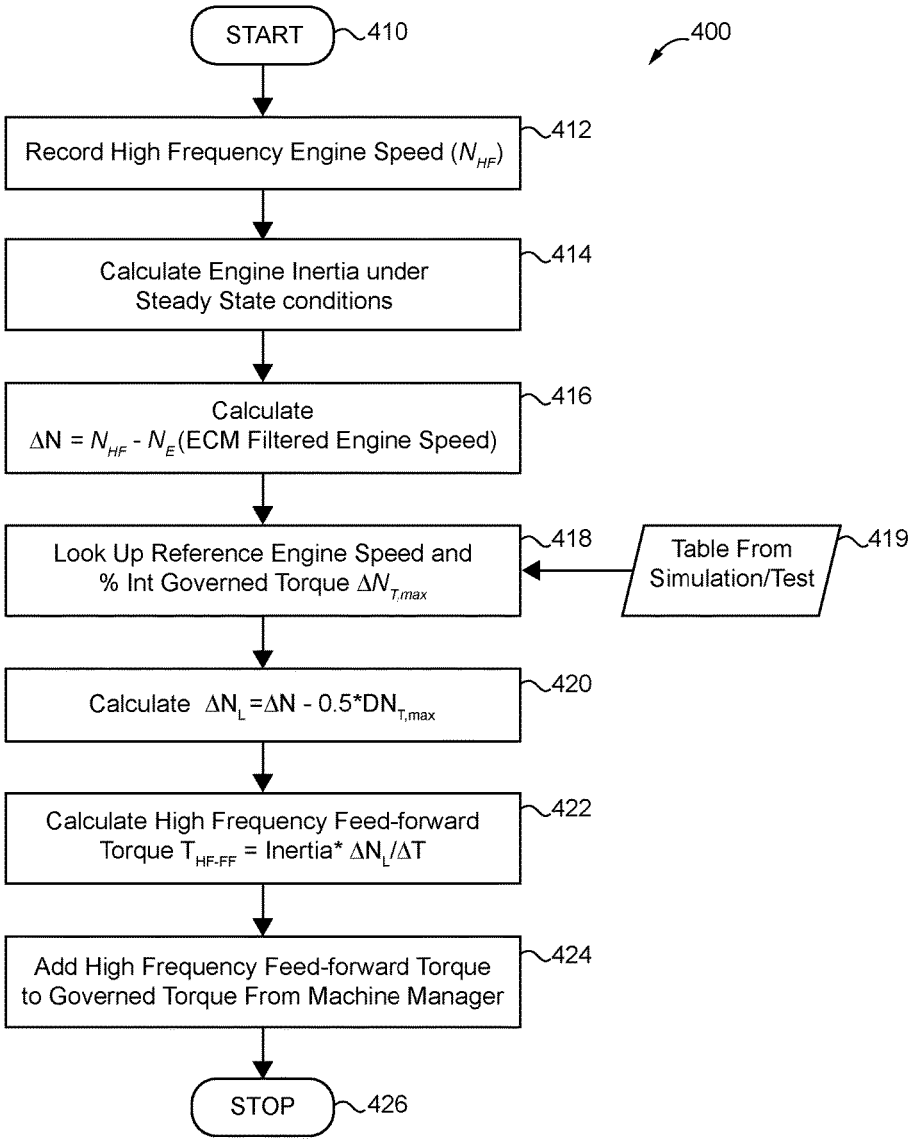
FIG. 4 is a flow diagram illustrating certain aspects of an exemplary engine control process.

With reference to FIG. 4 there is illustrated a flow diagram illustrating certain aspects of an exemplary engine control process 400. Process 400 begins at start operator 410 and proceeds to operator 412 which records or receives a high frequency engine speed value ($N_{HF}$). The high frequency engine speed value may be determined by sampling the output of an engine speed sensor at a sampling frequency selected to capture variation in engine torque attributable to the firing of one or more cylinders of the engine. From operator 412 process 400 proceeds to operator 414.

Operator 414 determines an engine inertia value under steady state conditions. The engine inertia value may be determined using a number of techniques including performing one or more calculations or table look-up operations. From operator 414 process 400 proceeds to operator 416 which determines an engine speed delta value ($\Delta N$) in response to the high frequency engine speed value ($N_{HF}$) and a filtered engine speed value ($N_E$). The filtered engine speed value may be determined by filtering a signal sampled from the output of an engine speed sensor, such as the high frequency engine speed value or another sampled value, using an averaging technique such as a moving and/or weighted average, an alpha-beta filtering technique, a state observer technique such as a Kalman filter or other techniques as would occur to one of skill in the art with the benefit of the present disclosure. In the illustrated embodiment the net engine speed delta value may be determined as the difference between the high frequency engine speed value and the filtered engine speed value, for example, in accordance with the equation $\Delta N = N_{HF} - N_E$. From operator 416 process 400 proceeds to operator 418.

Operator 418 performs a lookup operation to determine a value ($\Delta N_{T,max}$) which has been empirically determined as a maximum engine speed delta experienced at steady state operation due to torque variation which occurs during cylinder firing. In certain forms operator 418 may determine $\Delta N_{T,max}$ using a lookup table 419 which has been populated with empirically determined values for $\Delta N_{T,max}$ at a plurality of engine speeds and percent engine loads which may be queried as input axes to output a corresponding empirically determined value for $\Delta N_{T,max}$ corresponding to a given engine speed and percent load. The values of lookup table 419 may be determined empirically during offline testing of a given type or class of engines or alternative of an individual given engine.

From operator 418 process 400 proceeds to operator 420 which determines an engine speed delta attributable to variation in engine speed due to variation in load imposed on the engine ($\Delta N_L$). In some embodiments the engine speed delta may be determine in accordance with the equation $\Delta N_L = \Delta N - 0.5 * \Delta N_{T,max}$. From operator 420 process 400 proceeds to operator 422.

Operator 422 determines a high frequency feedforward torque correction value ($T_{HF\text{-}FF}$) in response to the engine inertia and variation in engine speed due to variation in load imposed on the engine ($\Delta N_L$). In certain forms the high frequency feedforward torque value may be determined in accordance with the equation $T_{HF\text{-}FF} = \text{Inertia} * \Delta N_L / \Delta T$ where $\Delta T$ is a time interval. From operator 422 process 400 proceeds to operator 424.

Operator 424 adds a high frequency feedforward torque to a governed torque value determined by a machine manager such as machine manager 320. From operator 424 process 400 proceeds to stop operator 426 where process 400 either stops or repeats.

Figure 5:
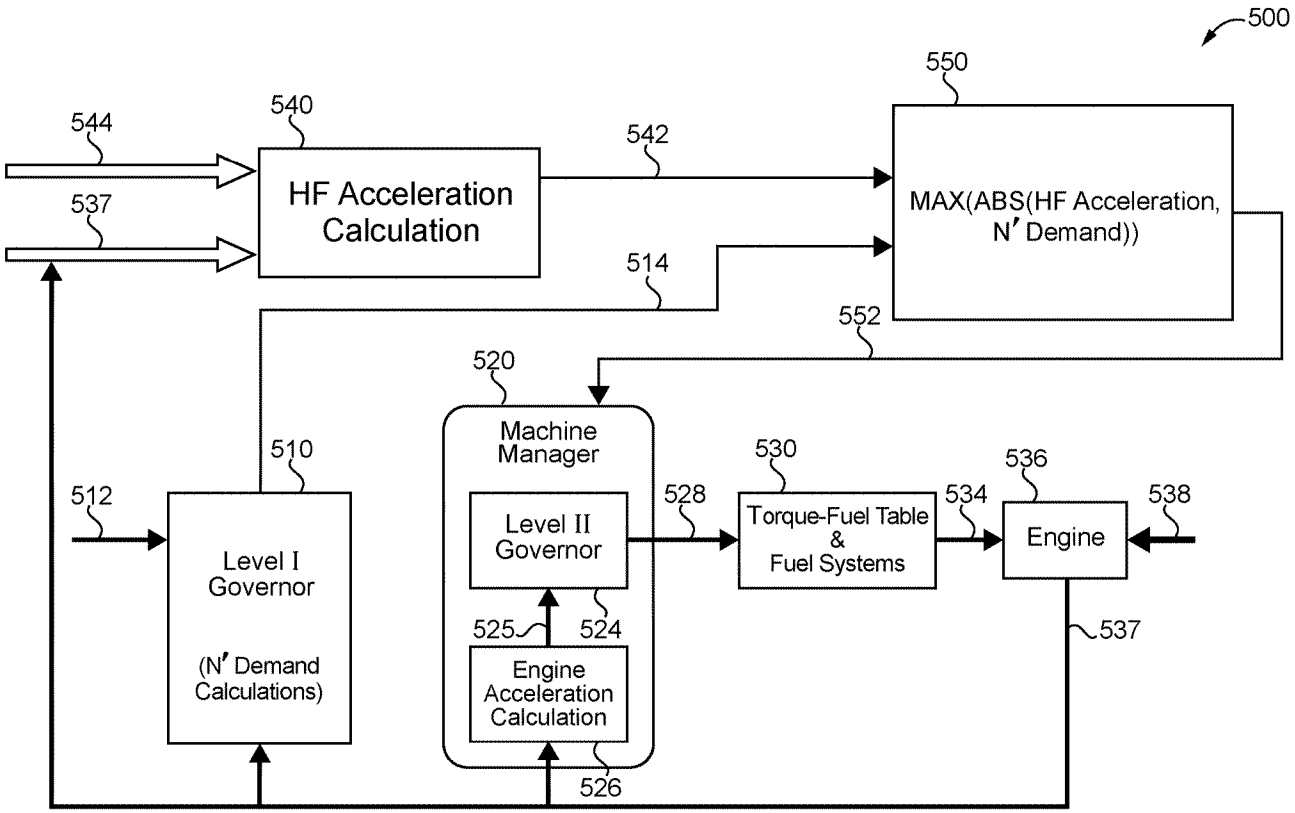
FIG. 5 is a block diagram illustrating certain aspects of exemplary engine controls.

With reference to FIG. 5 there is illustrated a block diagram depicting certain aspects of exemplary engine controls 500 which may be implemented in one or more control components of an electronic control system such as one or more electronic control system components illustrated and described in connection with FIG. 1. Controls 500 include one or more level I governors such as governor 510 which is structured to control engine speed. Governor 510 is structured as a feedback controller which receive as input an engine speed target value 512, sometimes referred to as an engine speed reference value, and a filtered engine speed feedback value 537. Governor 510 determines and outputs an engine acceleration target value 514 to reduce the difference or error between the engine speed target value 512 and the filtered engine speed feedback value 537. The engine acceleration target value 514 may be expressed as the first derivative of engine speed (N') and indicates a demanded change in engine speed to reduce the error between the inputs to governor 510. Engine acceleration target value 514 is provided to maximum determination operator 550 which is one example of a correction control component structured to correct an engine torque target value using a feedforward correction value.

Controls 500 further include feedforward control component 540. In the embodiment of FIG. 5 feedforward control component 540 is structured to receive as input a high frequency engine speed feedback value 544 and the filtered engine speed feedback value 537 and to determine and output a feedforward acceleration correction value 542. One example of operations that may be performed by feedforward control component 540 is described in connection with process 600 of FIG. 6, it being appreciated that other types of correction factor determinations may be utilized in other embodiments. Feedforward correction value 542 is provided to maximum determination operator 550 which determines and outputs a corrected engine acceleration target value 552 as the maximum of the absolute value of its received input values (e.g., MAX(ABS(N' Demand, $\Delta N_L$).

The corrected engine acceleration target value 552 is provided as input to governor 520 of machine manager 520 which includes one or more level II governors such as governor 524 which is structured to control engine torque and an engine acceleration calculator 526 which receives and processes the filtered engine speed feedback value 537 and determines and outputs an engine acceleration feedback value 525. Governor 524 is structured as a feedback controller, which receive the corrected engine acceleration target value 552 and the engine acceleration feedback value 525. Governor 524 determines and outputs a corrected engine torque target value 528 to reduce the difference or error between the engine acceleration target value 514 and the engine acceleration feedback value 525.

The corrected engine torque target value 528 is provided to torque-fuel table and fuel systems operator 530 which is structured to determine and output one or more fueling commands 532. In certain embodiments torque-fuel table and fuel systems operator 530 may determine one or more fueling control parameters, such fueling quantities, timings and rail pressures using one or more multidimensional lookup tables which correlate fueling control parameters to torque requests and other operating parameters. The fuel system components of engine 536 are structured to receive the one or more fueling commands 534 and to control fueling of the engine in response thereto. The operation of the engine is of course also influenced by the magnitude of variable load 538 which is driven by the engine.

Figure 6:
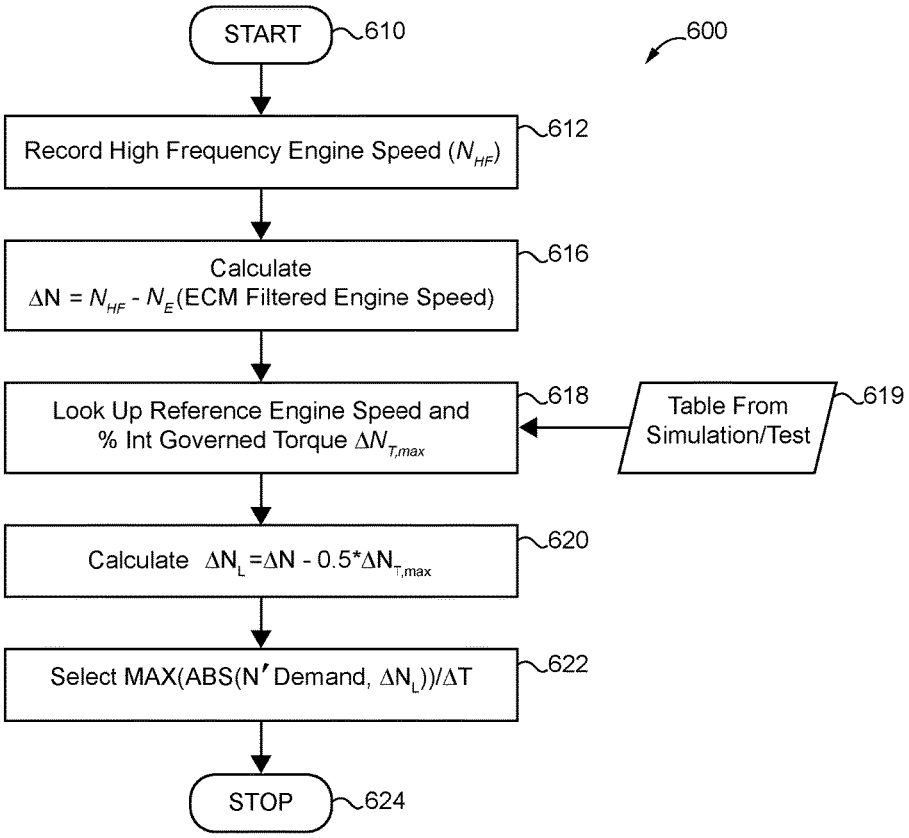
FIG. 6 is a flow diagram illustrating certain aspects of an exemplary engine control process.

With reference to FIG. 6 there is illustrated a flow diagram illustrating certain aspects of an exemplary engine control process 600. Process 600 begins at start operator 610 and proceeds to operator 612 which records or receives a high frequency engine speed value ($N_{HF}$). The high frequency engine speed value may be determined by sampling the output of an engine speed sensor at a sampling frequency selected to capture variation in engine torque attributable to the firing of one or more cylinders of the engine.

From operator 612 process 600 proceeds to operator 616 which determines an engine speed delta value ($\Delta N$) in response to the high frequency engine speed value ($N_{HF}$) and a filtered engine speed value ($N_E$). The filtered engine speed value may be determined by filtering a signal sampled from the output of an engine speed sensor, such as the high frequency engine speed value or another sampled value, using an averaging technique such as a moving and/or weighted average, an alpha-beta filtering technique, a state observer technique such as a Kalman filter or other techniques as would occur to one of skill in the art with the benefit of the present disclosure. In the illustrated embodiment the net engine speed delta value may be determined as the difference between the high frequency engine speed value and the filtered engine speed value, for example, in accordance with the equation $\Delta N = N_{HF} - N_E$. From operator 616 process 600 proceeds to operator 618.

Operator 618 performs a lookup operation to determine a value ($\Delta N_{T,max}$) which has been empirically determined as a maximum engine speed delta experienced at steady state operation due to torque variation which occurs during cylinder firing. In certain forms operator 618 may determine $\Delta N_{T,max}$ using a lookup table 619 which has been populated with empirically determined values for $\Delta N_{T,max}$ at a plurality of engine speeds and percent engine loads which may be queried as input axes to output a corresponding empirically determined value for $\Delta N_{T,max}$ corresponding to a given engine speed and percent load. The values of lookup table 619 may be determined empirically during offline testing of a given type or class of engines or alternative of an individual given engine.

From operator 618 process 600 proceeds to operator 620 which determines an engine speed delta attributable to variation in engine speed due to variation in load imposed on the engine ($\Delta N_L$). In some embodiments the engine speed delta may be determine in accordance with the equation $\Delta N_L = \Delta N - 0.5 * \Delta N_{T,max}$. From operator 620 process 600 proceeds to operator 622 which selects the maximum of variation in engine speed due to variation in load imposed on the engine ($\Delta N_L$) and an engine acceleration target value determined by a controller such as governor 510 (e.g., MAX (ABS(N' Demand, $\Delta N_L$))/$\Delta T$, where $\Delta T$ is a time interval. From operator 624 process 600 proceeds to stop operator 624 where process 600 either stops or repeats.

A number of exemplary embodiment shall now be further described. A first exemplary embodiment is a system comprising: an internal combustion engine operatively coupled with a variable load; and an electronic control system operatively coupled with the internal combustion engine, the electronic control system including a combination of control components structured to: receive an engine speed target value, a first engine speed feedback value, and a second engine speed feedback value, the second engine speed feedback value being a filtered engine speed value; process the first engine speed feedback value and the second engine speed feedback value to determine a feedforward correction value, the feedforward correction value correcting for first variation between the second engine speed feedback value and the first engine speed feedback value due to variation in the variable load and distinguishing between the first variation and a second variation due to operation of the internal combustion engine at steady state, process the engine speed target value, the second engine speed feedback value and the feedforward correction value to determine a fueling command, and control fueling of the internal combustion engine using the fueling command.

In certain forms of the first exemplary embodiment, the combination of control components comprises: a first feedback control component structured to determine an engine acceleration target value in response to the engine speed target value and the second engine speed feedback value, a second feedback control component structured to determine an engine torque target value in response to the engine acceleration target value and an engine acceleration feedback value, a feedforward control component structured to process the first engine speed feedback value and the second engine speed feedback value to determine the feedforward correction value, and a correction control component structured to correct the engine torque target value using the feedforward correction value. In certain forms the correction control component is structured to correct the engine torque target value by summing the feedforward correction value and the engine torque target value. In certain forms the feedforward control component is structured to: determine an engine inertia value, determine a net variation between the first engine speed feedback value and the second engine speed feedback value, determine the second variation using empirically predetermined data, determine the first variation based upon the net variation and the second variation, and determine the feedforward correction value based upon the first variation and the engine inertia value. In certain forms the combination of control components comprises: a first feedback control component structured to determine an engine acceleration target value in response to the first engine speed feedback value target and the second engine speed feedback value, a feedforward control component structured to process the first engine speed feedback value and the second engine speed feedback value to determine the feedforward correction value, a correction control component structured to determine a corrected engine acceleration target value in response to the engine acceleration target value and the feedforward correction value, and a second feedback control component structured to determine an engine torque target value in response to the corrected engine acceleration target and an engine acceleration feedback value. In certain forms the correction control component is structured to determine the corrected engine acceleration target by selecting the greater of the engine acceleration target and the feedforward correction value. In certain forms the feedforward control component is structured to: determine a net variation between the first engine speed feedback value and the second engine speed feedback value, determine the second variation using empirically predetermined data, determine the first variation based upon the net variation and the second variation, and determine the feedforward correction value based upon the first variation and the output of the first feedback control component.

A second exemplary embodiment is a method comprising: operating an electronic control system to control operation of an internal combustion engine coupled to a variable load by performing the acts of: receiving an engine speed target value, a first engine speed feedback value, and a second engine speed feedback value, the second engine speed feedback value being a filtered engine speed value, processing the first engine speed feedback value and the second engine speed feedback value to determine a feedforward correction value, the feedforward correction value correcting for first variation between the second engine speed feedback value and the first engine speed feedback value due to variation in the variable load and distinguishing between the first variation and a second variation due to operation of the internal combustion engine, processing engine speed target value, the second engine speed feedback value and the feedforward correction value to determine an engine fueling command, and controlling fueling of the internal combustion engine using the fueling command.

In certain forms of the second exemplary embodiment the act of operating the electronic control system comprises: determining with a first feedback control component an engine acceleration target value in response to the first engine speed feedback value target and the second engine speed feedback value, determining with a second feedback control component an engine torque target value in response to the engine acceleration target value and an engine acceleration feedback value, processing with a feedforward control component the first engine speed feedback value and the second engine speed feedback value to determine the feedforward correction value, and correcting with a correction control component the engine torque target value using the feedforward correction value. In certain forms the act of correcting the engine torque target value comprises summing the feedforward correction value and the engine torque target value. In certain forms the feedforward control component performs the acts of: determining an engine inertia value, determining a net variation between the first engine speed feedback value and the second engine speed feedback value, determining the second variation using empirically predetermined data, determining the first variation based upon the net variation and the second variation, and determining the feedforward correction value based upon the first variation and the engine inertia value. In certain forms the act of operating the electronic control system comprises: determining with a first feedback control component an engine acceleration target value in response to the first engine speed feedback value target and the second engine speed feedback value, processing with a feedforward control component the first engine speed feedback value and the second engine speed feedback value to determine the feedforward correction value, determining with a correction control component a corrected engine acceleration target value in response to the engine acceleration target and the feedforward correction value, and determining with a second feedback control component an engine torque target value in response to the corrected engine acceleration target and an engine acceleration value. In certain forms the act of determining the corrected engine acceleration target comprises selecting the greater of the engine acceleration target and the feedforward correction value. In certain forms the feedforward control component performs the acts of: determining a net variation between the first engine speed feedback value and the second engine speed feedback value, determining the second variation using empirically predetermined data, determining the first variation based upon the net variation and the second variation, and determining the feedforward correction value based upon the first variation and the output of the first feedback control component.

A third exemplary embodiment is an apparatus comprising: an electronic control system structured to control operation of an internal combustion engine coupled to a variable load by performing the acts of: receiving an engine speed target, a first engine speed feedback, and a second engine speed feedback, the second engine speed feedback being a filtered engine speed, processing the first engine speed feedback and the second engine speed feedback to determine a feedforward correction, the feedforward correction correcting for first variation between the second engine speed feedback and the first engine speed feedback due to variation in the variable load and distinguishing between the first variation and a second variation due to operation of the internal combustion engine, processing engine speed target, the second engine speed feedback and the feedforward correction to determine an engine fueling command, and controlling fueling of the internal combustion engine using the fueling command.

In certain forms of the third exemplary embodiment the electronic control system is structured to perform the acts of: determining with a first feedback control component an engine acceleration target in response to the first engine speed feedback target and the second engine speed feedback, determining with a second feedback control component an engine torque target in response to the engine acceleration target and an engine acceleration feedback, processing with a feedforward control component the first engine speed feedback and the second engine speed feedback to determine the feedforward correction, and correcting with a correction control component the engine torque target using the feedforward correction. In certain forms the feedforward control component is structured to performs the acts of: determining an engine inertia, determining a net variation between the first engine speed feedback and the second engine speed feedback, determining the second variation using empirically predetermined data, determining the first variation based upon the net variation and the second variation, and determining the feedforward correction based upon the first variation and the engine inertia. In certain forms the electronic control system is structured to perform the acts of: determining with a first feedback control component an engine acceleration target in response to the first engine speed feedback target and the second engine speed feedback, processing with a feedforward control component the first engine speed feedback and the second engine speed feedback to determine the feedforward correction, determining with a correction control component a corrected engine acceleration target in response to the engine acceleration target and the feedforward correction, and determining with a second feedback control component an engine torque target in response to the corrected engine acceleration target and an engine acceleration. In certain forms the feedforward control component is structured to perform the acts of: determining a net variation between the first engine speed feedback value and the second engine speed feedback value, determining the second variation using empirically predetermined data, determining the first variation based upon the net variation and the second variation, and determining the feedforward correction value based upon the first variation and the output of the first feedback control component. In certain forms the first engine speed feedback is sampled at a frequency selected to capture variation in engine torque attributable to the firing of one or cylinders of the engine. In certain forms the variable load comprises one of a mechanical load, a hydraulic load, and a pneumatic load.

While illustrative embodiments of the disclosure have been illustrated and described in detail in the drawings and foregoing description, the same is to be considered as illustrative and not restrictive in character, it being understood that only certain exemplary embodiments have been shown and described and that all changes and modifications that come within the spirit of the claimed inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A system comprising:

an internal combustion engine operatively coupled with a variable load; and an electronic control system operatively coupled with the internal combustion engine, the electronic control system including a combination of control components structured to:

receive an engine speed target value, a first engine speed feedback value, and a second engine speed feedback value, the second engine speed feedback value being a filtered engine speed value;

process the first engine speed feedback value and the second engine speed feedback value to determine a feedforward correction value, the feedforward correction value correcting for first variation between the second engine speed feedback value and the first engine speed feedback value due to variation in the variable load and distinguishing between the first variation and a second variation due to operation of the internal combustion engine at steady state, process the engine speed target value, the second engine speed feedback value and the feedforward correction value to determine a fueling command, and control fueling of the internal combustion engine using the fueling command.

2. The system of claim 1, wherein the combination of control components comprises:

a first feedback control component structured to determine an engine acceleration target value in response to the engine speed target value and the second engine speed feedback value, a second feedback control component structured to determine an engine torque target value in response to the engine acceleration target value and an engine acceleration feedback value, a feedforward control component structured to process the first engine speed feedback value and the second engine speed feedback value to determine the feedforward correction value, and a correction control component structured to correct the engine torque target value using the feedforward correction value.

3. The system of claim 2 wherein the correction control component is structured to correct the engine torque target value by summing the feedforward correction value and the engine torque target value.

4. The system of claim 2 wherein the feedforward control component is structured to:

determine an engine inertia value, determine a net variation between the first engine speed feedback value and the second engine speed feedback value, determine the second variation using empirically predetermined data, determine the first variation based upon the net variation and the second variation, and determine the feedforward correction value based upon the first variation and the engine inertia value.

5. The system of claim 1, wherein the combination of control components comprises:

a first feedback control component structured to determine an engine acceleration target value in response to the first engine speed feedback value target and the second engine speed feedback value, a feedforward control component structured to process the first engine speed feedback value and the second engine speed feedback value to determine the feedforward correction value, a correction control component structured to determine a corrected engine acceleration target value in response to the engine acceleration target value and the feedforward correction value, and a second feedback control component structured to determine an engine torque target value in response to the corrected engine acceleration target and an engine acceleration feedback value.

6. The system of claim 5 wherein the correction control component is structured to determine the corrected engine acceleration target by selecting the greater of the engine acceleration target and the feedforward correction value.

7. The system of claim 5 wherein the feedforward control component is structured to:

determine a net variation between the first engine speed feedback value and the second engine speed feedback value, determine the second variation using empirically predetermined data, determine the first variation based upon the net variation and the second variation, and determine the feedforward correction value based upon the first variation and the output of the first feedback control component.

8. A method comprising:

operating an electronic control system to control operation of an internal combustion engine coupled to a variable load by performing the acts of:

receiving an engine speed target value, a first engine speed feedback value, and a second engine speed feedback value, the second engine speed feedback value being a filtered engine speed value, processing the first engine speed feedback value and the second engine speed feedback value to determine a feedforward correction value, the feedforward correction value correcting for first variation between the second engine speed feedback value and the first engine speed feedback value due to variation in the variable load and distinguishing between the first variation and a second variation due to operation of the internal combustion engine, processing engine speed target value, the second engine speed feedback value and the feedforward correction value to determine an engine fueling command, and controlling fueling of the internal combustion engine using the fueling command.

9. The method of claim 8, wherein the act of operating the electronic control system comprises:

determining with a first feedback control component an engine acceleration target value in response to the first engine speed feedback value target and the second engine speed feedback value, determining with a second feedback control component an engine torque target value in response to the engine acceleration target value and an engine acceleration feedback value, processing with a feedforward control component the first engine speed feedback value and the second engine speed feedback value to determine the feedforward correction value, and correcting with a correction control component the engine torque target value using the feedforward correction value.

10. The method of claim 9 wherein the act of correcting the engine torque target value comprises summing the feedforward correction value and the engine torque target value.

11. The method of claim 9 wherein the feedforward control component performs the acts of:

determining an engine inertia value, determining a net variation between the first engine speed feedback value and the second engine speed feedback value, determining the second variation using empirically predetermined data, determining the first variation based upon the net variation and the second variation, and determining the feedforward correction value based upon the first variation and the engine inertia value.

12. The method of claim 8, wherein the act of operating the electronic control system comprises:

determining with a first feedback control component an engine acceleration target value in response to the first engine speed feedback value target and the second engine speed feedback value, processing with a feedforward control component the first engine speed feedback value and the second engine speed feedback value to determine the feedforward correction value, determining with a correction control component a corrected engine acceleration target value in response to the engine acceleration target and the feedforward correction value, and determining with a second feedback control component an engine torque target value in response to the corrected engine acceleration target and an engine acceleration value.

13. The method of claim 12 wherein the act of determining the corrected engine acceleration target comprises selecting the greater of the engine acceleration target and the feedforward correction value.

14. The method of claim 12 wherein the feedforward control component performs the acts of:

determining a net variation between the first engine speed feedback value and the second engine speed feedback value, determining the second variation using empirically predetermined data, determining the first variation based upon the net variation and the second variation, and determining the feedforward correction value based upon the first variation and the output of the first feedback control component.

15. An apparatus comprising:

an electronic control system structured to control operation of an internal combustion engine coupled to a variable load by performing the acts of:

receiving an engine speed target, a first engine speed feedback, and a second engine speed feedback, the second engine speed feedback being a filtered engine speed, processing the first engine speed feedback and the second engine speed feedback to determine a feedforward correction, the feedforward correction correcting for first variation between the second engine speed feedback and the first engine speed feedback due to variation in the variable load and distinguishing between the first variation and a second variation due to operation of the internal combustion engine, processing engine speed target, the second engine speed feedback and the feedforward correction to determine an engine fueling command, and controlling fueling of the internal combustion engine using the fueling command.

16. The apparatus of claim 15, wherein the electronic control system is structured to perform the acts of:

determining with a first feedback control component an engine acceleration target in response to the first engine speed feedback target and the second engine speed feedback, determining with a second feedback control component an engine torque target in response to the engine acceleration target and an engine acceleration feedback, processing with a feedforward control component the first engine speed feedback and the second engine speed feedback to determine the feedforward correction, and correcting with a correction control component the engine torque target using the feedforward correction.

17. The apparatus of claim 16 wherein the feedforward control component is structured to performs the acts of:

determining an engine inertia, determining a net variation between the first engine speed feedback and the second engine speed feedback, determining the second variation using empirically predetermined data, determining the first variation based upon the net variation and the second variation, and determining the feedforward correction based upon the first variation and the engine inertia.

18. The apparatus of claim 15, wherein the electronic control system is structured to perform the acts of:

determining with a first feedback control component an engine acceleration target in response to the first engine speed feedback target and the second engine speed feedback, processing with a feedforward control component the first engine speed feedback and the second engine speed feedback to determine the feedforward correction, determining with a correction control component a corrected engine acceleration target in response to the engine acceleration target and the feedforward correction, and determining with a second feedback control component an engine torque target in response to the corrected engine acceleration target and an engine acceleration.

19. The apparatus of claim 18 wherein the feedforward control component is structured to perform the acts of:

determining a net variation between the first engine speed feedback value and the second engine speed feedback value, determining the second variation using empirically predetermined data, determining the first variation based upon the net variation and the second variation, and determining the feedforward correction value based upon the first variation and the output of the first feedback control component.

20. The apparatus of claim 15 wherein the first engine speed feedback is sampled at a frequency selected to capture variation in engine torque attributable to the firing of one or cylinders of the engine.

21. The apparatus of claim 15 wherein the variable load comprises one of a mechanical load, a hydraulic load, and a pneumatic load.

* * * * *